United States Patent [19]

Hall Vandis

[11] Patent Number: 4,710,145

[45] Date of Patent: Dec. 1, 1987

[54] THERAPEUTIC DOLL FIGURE

[76] Inventor: Nancy Hall Vandis, 4730 Laurel Grove Ave., North Hollywood, Calif. 91607

[21] Appl. No.: 686,647

[22] Filed: Dec. 27, 1984

[51] Int. Cl.[4] ..... A63H 3/16; A63H 3/28; A63H 3/44

[52] U.S. Cl. ..... 446/100; 434/236; 434/267; 446/302

[58] Field of Search ..... 434/98, 236, 306; 446/100, 175, 297, 299, 302; 434/265, 267

[56] References Cited

U.S. PATENT DOCUMENTS

| | | | |
|---|---|---|---|
| 3,047,670 | 7/1962 | Gardner | 446/297 X |
| 3,162,980 | 12/1964 | Hellman | 446/302 |
| 3,239,229 | 3/1966 | Freeman | 446/302 X |
| 3,469,039 | 9/1969 | Lee | 446/302 X |
| 3,949,488 | 4/1976 | Welch | 434/98 |
| 4,122,628 | 10/1978 | Crowell | 446/100 |
| 4,208,832 | 6/1980 | Corriveau | 446/100 |
| 4,245,430 | 1/1981 | Hoyt | 446/175 |

FOREIGN PATENT DOCUMENTS

| | | | |
|---|---|---|---|
| 566160 | 11/1973 | Switzerland | 446/100 |

*Primary Examiner*—William H. Grieb
*Attorney, Agent, or Firm*—Robert J. Schaap

[57] ABSTRACT

A therapeutic doll figure having a doll body with at least a head section and a torso section. A transport, such as a tape transport, with a recordable medium, such as a tape cassette is located within the doll body and is capable of having a message recorded thereon and which message may also be reproduced therefrom. A speaker is located within the doll and preferably at a representation of a mouth portion on the head section of the doll for generating the reproduced message. A microphone can be located on the doll and preferably in the ear of the doll and connected to the tape transport for recording a message on the tape cassette. Further, a manually actuable switch can be located behind a representation of a heart on the doll in order to start or stop the tape transport. In another aspect of the invention, the facial expression of the doll can be changed in order to represent known or unknown human persons.

18 Claims, 7 Drawing Figures

THERAPEUTIC DOLL FIGURE

BACKGROUND OF THE INVENTION

1. Field of the Invention

This invention relates in general to certain new and useful improvements in doll figures, and more particularly, in doll figures which are capable of performing a therapeutic function by generating a message of a known or unknown person and also capable of having facial expressions altered to attempt to represent a known or unknown person.

2. Brief Description of the Prior Art

Dolls have long been used as play toys for children including both male and female children. Moreover, there have been dolls which are sold in kit form along with a wardrobe of clothing for that doll in order to enable the dress form of the doll to be changed at the will of the child.

Heretofore, there have also been dolls with sound generating mechanisms located within the doll. For example, in the case of non-human toys, a sound generating mechanism can be made to generate the sound of e.g. a cow when a portion of the cow, e.g. the tail of the cow is moved. In addition, there have been toy dolls which are capable of generating sounds such as a crying sound or a sound such as the word "Mama" when the doll is moved. Each of these aforesaid sound generating mechanisms are limited in the sounds that can be produced or for that matter, the words or phrases which can be produced.

In addition to the foregoing, there have been dolls which are capable of generating a sentence or perhaps two sentences when a string is pulled on the doll. This string, when pulled, causes the rotation of a drum or similar sound producing member and in conjunction with an associated mechanism causes the generation of the sound. Here again, the message is fixed and cannot be changed and moreover, it is a message of an unknown person which has nothing to do with the child itself or people in close relationship to the child.

In child therapy, the therapist will oftentimes attempt to use a doll figure in order to communicate with a child patient. The doll is usually comfortable to the child since it is soft, light in weight, and convenient for the child to hold and is an object to which the child can cling. However, in this type of child therapy, the doll is an inanimate, silent object and therefore has limited value. It has been recognized that the doll could have significantly greater value if the doll were capable of becoming part of the communication path between the therapist and the child.

It has also been recognized that children who must remain in a hospital environment for physical health purposes, will oftentimes heal more rapidly if they are in the presence of loved ones, as for example, their parents and brothers or sisters. However, in many cases, it is impractical, if not impossible to have the parents immediately present and particularly where the child must be in a quarantine area. Consequently, it would be desirable to have a doll figure which is capable of also operating in a communication path between the parent and the child.

In addition to the foregoing, it would also be highly desirable to have a doll figure in which the facial expressions of that doll can be changed. In this way, the child, or for that matter, an adult can attempt to change the facial expressions of the doll figure to conform to that of a known or unknown human being.

OBJECTS OF THE INVENTION

It is, therefore, one of the primary objects of the present invention to provide a therapeutic doll figure which is capable of receiving and recording speech of a person and generating the speech of that person to simulate the presence of that person through the doll figure.

It is another object of the present invention to provide a therapeutic doll figure which can be highly effective in therapist-patient relationships, and particularly with children in child therapy relationships.

It is a further object of the present invention to provide a therapeutic doll figure which utilizes a tape transport having a recordable tape in which messages of a known or unknown person can be recorded and reproduced therefrom at a later time.

It is also an object of the present invention to provide a therapeutic doll figure of the type stated and which has a head section with the representation of a human face and where components may be attached to or removed from that representation of the human face in order to simulate the presence of a human known or unknown person.

It is another salient object of the present invention to provide a therapeutic doll figure of the type stated which can be manufactured and produced at a relatively low cost but which is highly effective in therapy type situations.

It is still a further object of the present invention to provide an anthropomorphic tape recording mechanism which is fashioned in the form of a doll figure.

With the above and other objects in view, my invention resides in the novel features of form, construction, arrangement and combination of parts presently described and pointed out in the claims.

BRIEF SUMMARY OF THE DISCLOSURE

A therapeutic doll figure capable of recording the speech of a person and generating the speech of that person in order to simulate the presence of that person through the doll figure. The therapeutic doll figure also has a head section with a representation of a human face and is constructed so that additional features can be added to or removed from the representation of the face in order to simulate a known or unknown human person.

In one embodiment of the invention, the doll figure comprises a doll body having a head section and a torso section. As desired, the doll body could include arms and a lower body section having legs. More preferably, the doll body should be unisexual in nature so that by adding additional features, the doll could adopt the representation of either a female or a male.

In one embodiment of the invention, a transport such as a tape transport is associated with the doll body and preferably located within the doll figure body. The transport includes a recordable medium such as a tape cassette on which a spoken message may be recorded and form which that message may be reproduced. A read-write means is associated with the transport for recording and reproducing the message from the recordable medium. In a preferred embodiment, the read-write means may include a recording head and a reproducing head as well as an erase head.

A speaker is located in or on the doll figure and is operatively connected to the transport and the read-write means in order to reproduce a message of a person through the doll figure in order to simulate the presence of the person producing that message. In a more preferred embodiment, the head section of the doll figure includes a representation of a mouth and the speaker is located in the head of the doll body immediately behind the mouth.

The therapeutic doll figure also comprises a microphone which is located on the doll body and is operatively connected to the transport and the read-write means to enable a message to be recorded on the recordable media, such as the tape cassette. Again, and in a more preferred embodiment, the head section of the doll body is provided with a representation of an ear and the microphone is located in the doll body and immediately behind the representation of the ear. In a more preferred embodiment, a microphone which would be connected to the tape transport and the read-write means is located behind each of the individual ears.

The doll figure may also include various switch means in order to enable the tape transport to be placed in the recording mode or the speech generating mode or for that matter, the erasing mode. The doll figure may comprise a representation of a human heart on the torso section of the doll body or on doll clothing immediately over the torso section in the region where a human heart would be located. Further, a respresentation of a human heart can be located on the torso section of the doll figure body and a separate representation of a human heart can be located on the clothing of the doll figure body immediately over the region where a human heart would be located so that the heart is present when the doll figure is undressed. One or all of the switch means can be located immediately behind this representation of the human heart. The switch means would be manually actuable, as for example, by pressing on the representation of the heart to start the transport and either the recording or the reproducing.

The therapeutic doll figure may also be considered to be an anthropomorphic tape recording mechanism, that is, a tape recording mechanism or similar sound generating mechanism which is in the form of a doll figure. Thus, the invention may be perceived as a tape recording mechanism having a tape transport in which a tape is movable across a sound recording head and a sound producing head along with the associated switches and which tape transport is incorporated in or fashioned to appear as a doll figure.

As indicated previously, the doll has a representation of a human face thereon. This representation of a face may include a representation of eyes, a representation of a mouth, and a representation of a nose. A first means of attachment, as for example, a Velcro strip is closely associated with and closely located with respect to the representation of a mouth and which enables attachment and removal of an element to enable alteration of facial appearances. The doll figure also comprises a second means of attachment associated with and closely located with respect to the representation of the eyes and which enables attachment and removal of another element to also enable alteration of facial appearance. In a preferred embodiment, these elements for attachment and removal enable the doll figure to represent a human known or unknown person. It is also possible to use other forms of attachment means.

As indicated above, the means of attachment and removal are Velcro strips and which combine with the face on the doll head to provide a facial appearance in absence of the attachment of any elements thereto. For example, the Velcro strips can be located above the eyes to represent eye lashes. A pair of eyeglasses could be provided which include mating Velcro strips to attach to the representation of the eyebrows.

This invention possesses many other advantages and has other purposes which may be made more clearly apparent from a consideration of the forms in which it may be embodied. These forms are shown in the drawings forming part of and accompanying the present specification. They will now be described in detail for purposes of illustrating the general principles of the invention, but it is to be understood that such detailed descriptions are not to be taken in a limiting sense.

BRIEF DESCRIPTION OF THE DRAWINGS

Figure 1:
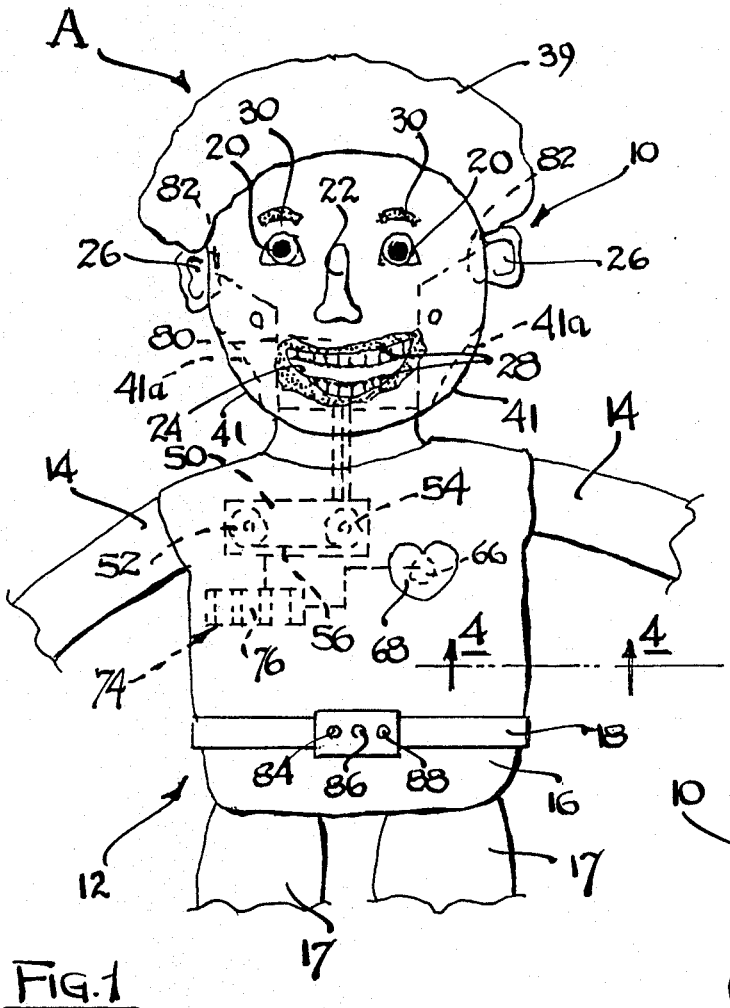
Figure 4:
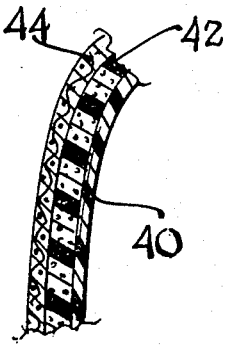
Figure 2:
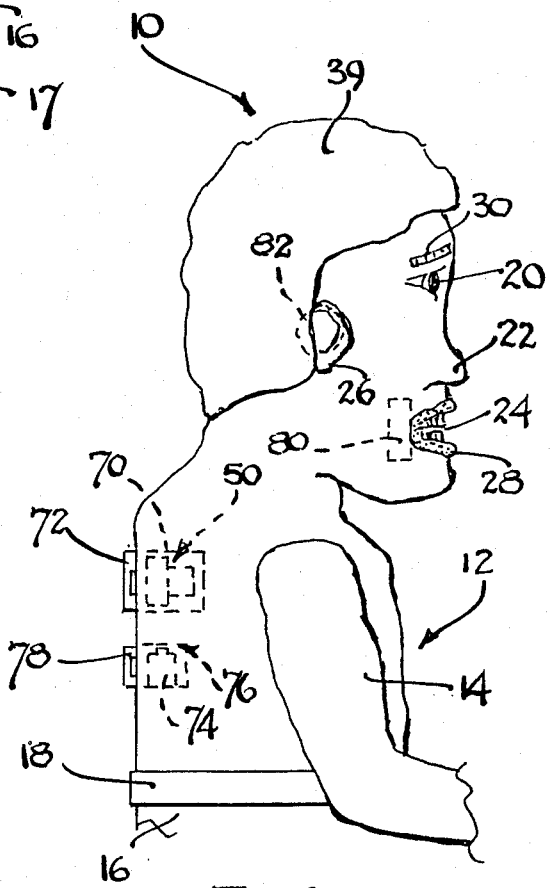
Figure 5:
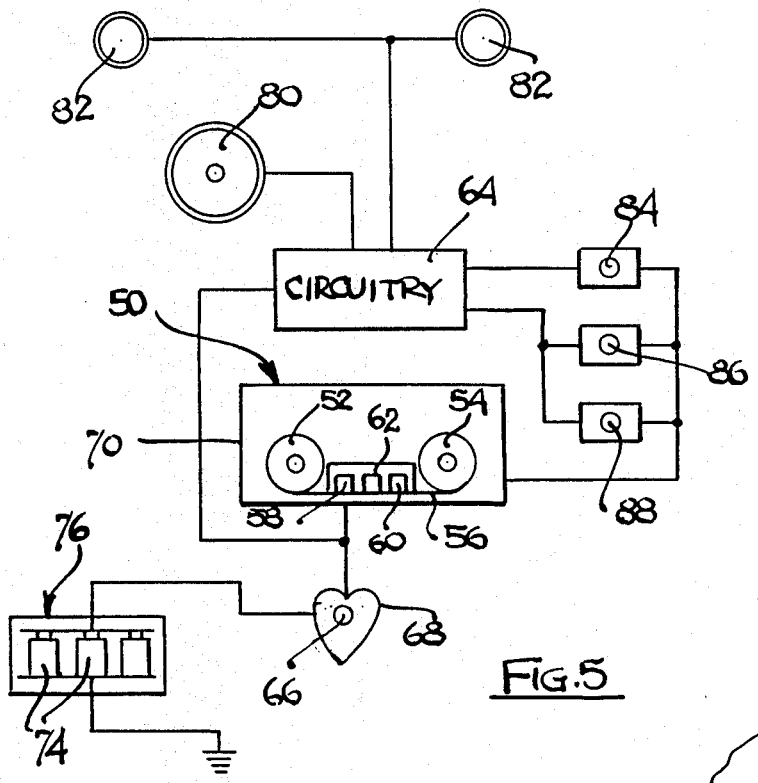
Figure 6:
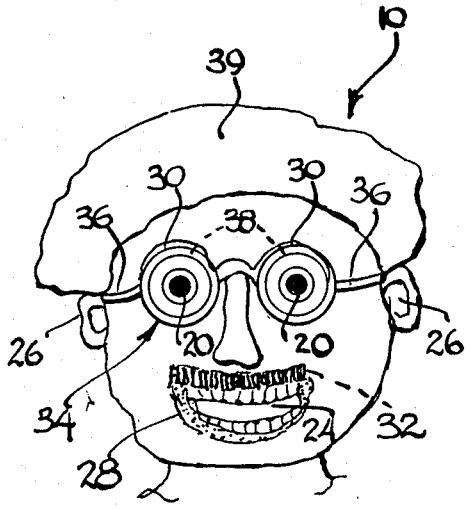
Figure 3:
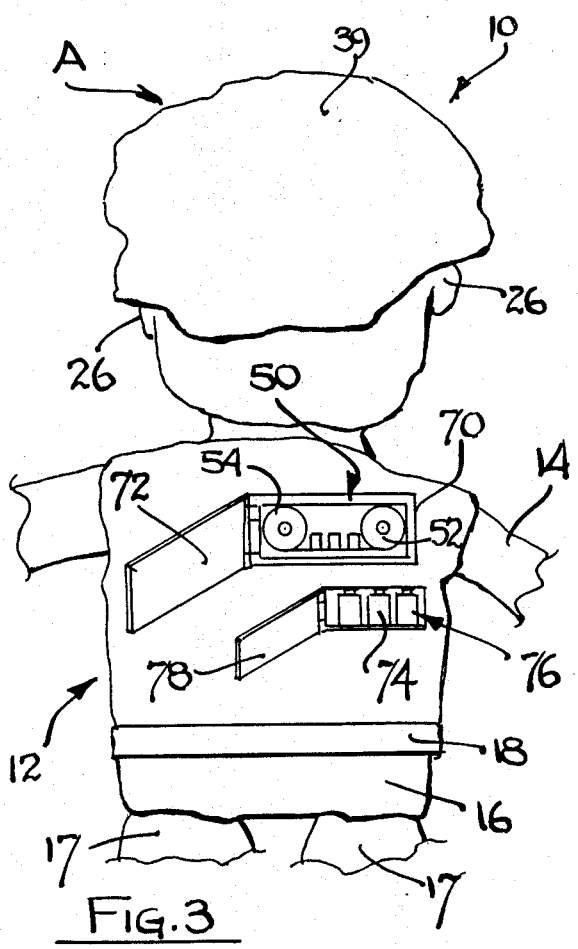
Figure 7:
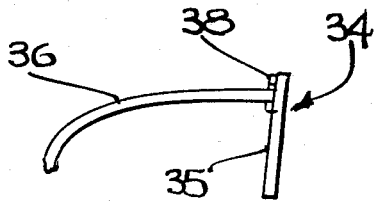

Having thus described the invention in general terms, reference will now be made to the accompanying drawings in which:

FIG. 1 is a fragmentary front elevational view of a therapeutic doll figure constructed in accordance with and embodying the present invention;

FIG. 2 is a fragmentary side elevational view of the therapeutic doll figure, partially broken away;

FIG. 3 is a rear elevational view of the therapeutic doll figure of FIG. 1;

FIG. 4 is a horizontal sectional view taken along line 4—4 of FIG. 1 rotated 90 degrees;

FIG. 5 is a schematic circuit view showing portions of the circuitry used in the therapeutic doll figure of the present invention;

FIG. 6 is an enlarged front elevational view of the therapeutic doll figure having a human face with attachments thereto; and FIG. 7 is a side elevational view of an attachment in the form of a pair of eyeglasses which can be used to alter the facial appearance of the therapeutic doll figure.

DETAILED DESCRIPTION OF THE PREFERRED EMBODIMENT

Referring now in more detail and by reference characters to the drawings which illustrate practical embodiments of the present invention, A designates a therapeutic doll figure of the type which is capable of having speech recorded and generated therefrom to simulate the presence of that person and which doll figure is also capable of having facial appearance modified to simulate the presence of known or unknown human persons.

The therapeutic doll figure A comprises a head section 10 and a torso section 12 along with a pair of arms 14 thereon. In the representation of the doll figure A as illustrated, the doll figure may also include a lower body section 16 having legs 17 and with a belt 18 at the waist portion thereof. The configuration of the doll figure A can vary such that a larger lower body section 16 could be provided with differently formed legs.

The head section 10 of the therapeutic doll figure includes the representation of a human face, which in this embodiment is intended to be and is unisexual in appearance. The representation of the human face, in this embodiment includes a pair of eyes 20 and a representation of a nose 22, a representation of a mouth 24 and projections representing ears 26.

The representation of a mouth 24 may include an opening and also includes a pair of attachment means 28 on the upper and lower portions of the mouth, and which attachment means may be in form of elements representing lips. In like manner, a pair of separate attachment means 30 is located above each one of the representations of the eyes 20 and may be in the form of elements which are representations of eyebrows. In this case, the attachment means 28 and 30 may be e.g. Velcro fiber attachment strips.

Adapted for attachment to the Velcro fiber attachment strips 28 is a representation of a moustache 32 which is more fully illustrated in the phantom lines of FIG. 6. In like manner, adapted to attachment to the Velcro strips 30 which functions as eyebrows are a pair of glasses 34 which are shown in the representation of the human face in FIG. 6. In this case, the eyeglasses includes a frame 35 and a pair of ear pieces 36. The frame 35 includes mating attachment strips 38 on each of the eyeglass sections in order to releasably mate with the Velcro attachment strips 30. In this way, the mating Velcro strips 38 will become releasably attached to the Velcro strips 30 upon contact when the glasses are disposed upon the representation of the face of the human figure. In like manner, the representation of the moustache 32 is similarly provided with a Velcro strip on its lower portion and which is adapted to mate with the Velcro strip 28 which also functions as an upper lip portion.

Located on the top portion of the head section 10 is a body of hair 39 and which may be permanently affixed to the head section 10 or removably secured thereto. In a preferred embodiment the body of hair 39 is removable so that another differently styled body of hair may be removably attached. For this purpose Velcro fiber strips or other attachment means may be employed.

The doll figure could have other portions of the head section 10 which are removable and replaceable by similar sections. For example, cheek portions 41 of the head section 10 could be removed so as to provide a facial contour along the dotted lines 41*a*.

It should also be understood that various other elements could be provided with the therapeutic doll figure for attachment to the representation of the face in other areas. Exemplary of other features which may be attached (not shown) is a beard which can be attached for example, to the Velcro attachment strip 28 which functions as the lower lip. In like manner, a Velcro attachment means could be located on the forehead of the face, for example to attach a hat or similar member. In this way, the facial characteristics of the representation of the face can be altered. In accordance with this construction, it is possible for the user of the therapeutic doll figure to construct a facial representation which approximates that of a person which may be known or for that matter, a person which is unknown.

The various attachment means on the representation of the face of the doll figure actually form part of the characterization which is depicted by the facial expression. For example, the Velcro strips 30 actually function as eyebrows. Moreover, they also function as an attachment means when the eye glasses 34 are attached to the doll figure. In like manner, the Velcro strips 28 function as lips when nothing else is attached to these strips. Moreover, they also function as an attachment means. The doll figure could be constructed so that other attachment means could also form part of the facial expression and could also be adapted to have other elements attached thereto.

It is also possible to use other forms of attachments which are commercially available. For example, the head section of the doll figure could be formed of a smooth soft material such as nylon cloth like material which contains Micro-sized loops adapted for releasable attachment to a fiber containing Velcro strip which operates much in the same manner as Velcro fiber fasteners. Attachment systems of this type are offered by William J. Dixon Co., Inc. of Exton, Pa. under the number 11611S.

It is also possible to incorporate holograms on the surface of the doll body and particularly the head section 10. In this way, some of the features of the doll figure can present a three-dimensional appearance.

The entire body of the therapeutic doll figure is preferably constructed of three layers which includes a relatively rigid, hard inner plastic shell 40, as more fully illustrated in FIG. 4. Disposed over the shell 40 is a plastic foam layer, such as a urethane foam layer 42, which is, in turn, covered by an outer cloth covering 44. The urethane foam may be secured to the exterior surface of the rigid plastic shell 40 by means of a suitable adhesive or other means for conventionally securing the foam to the plastic shell. In like manner, the outer cloth covering 44 can be secured to the interior urethane foam layer 42 by an adhesive coating or by stitching, or other conventional means. This construction has been found to provide a very soft and yieldable skin-like softness and one which is easy for a younger person to hold and, in effect to hug, or "cuddle".

It should be understood that the body of the therapeutic doll figure could be formed of other substances and could be formed of other materials. For example, various known plastics may be used in construction of the shell and various foam materials may be employed as an inner layer. In like manner, various known plastics could also be used in place of the cloth covering. It should also be understood that various other combinations of components could be used in order to create a body structure which was yieldable and convenient for touch and holding and hugging by a human child.

The therapeutic doll figure of the present invention also includes a system for recording speech or other sounds of known or unknown persons and for re-presenting those sounds or speech. In the embodiments as illustrated, the therapeutic doll figure comprises a transport, such as a tape transport 50, which is generally of conventional construction and includes a tape supply spool 52 with a take-up spool 54 and a recordable tape 56 extending therebetween. The tape transport 50 conventionally includes at least a write head 58, a read head 60 and an erase head 62 which may be included in a single bank of these heads. In some cases, the write head 58 and read head 60 can be combined as a single tape head.

The tape transport 50 would also include motors such as servo motors and the like, (not shown) and other circuitry of the type normally included with these tape transports. The tape transport 50 may also be provided with a tape counter. For this purpose, the tape counter could be located close to the surface of the doll figure body and slightly hidden so as to be viewable only upon close observation. In addition, a message-waiting light or similar signal device could also be incorporated into the tape transport 50. Inasmuch as these transports are conventional in construction, they will be neither illustrated nor described in any further detail herein.

The tape transport 50 is shown as being connected to conventional electrical circuitry 64 which may form part of and may be included in the tape transport itself.

Moreover, an off-on switch such as a switch 66 may be located on the body of the therapeutic doll figure. In this case, the switch 66 is capable of being actuated by manually pressing, such that one manual actuation will turn the switch on and a subsequent actuation will turn the switch off. In addition, this switch may be located behind the representation of a heart 68 which may be a patch sewn or otherwise affixed to the surface of the therapeutic doll figure, as illustrated or to the outer clothing of the doll figure over the area where a heart would be situated.

The tape transport 50 including the associated electrical circuitry 64 can be conveniently mounted within the body of the therapeutic doll figure in the manner as illustrated in FIGS. 2 and 3 of the drawings. For this purpose, the therapeutic doll figure can be provided with a first somewhat rectangularly shaped casing 70 located within a torso section 12 of the doll body toward the rearward portion thereof. A hingedly mounted door 72 can provide access to this compartment or casing 70 for purposes of servicing the tape transport or the tape which may be mounted thereon. Moreover, the transport can be conveniently retained in this casing by means of brackets or the like, as may be required.

The tape transport 50 including the circuitry 64 can be conveniently powered by conventional batteries, such as C-cell 1.5 volt batteries. In like manner, the conventional transistor radio 9.6 volt battery can also be employed if desired. A bank of these batteries 74 is located within another rectangularly shaped compartment or casing 76 formed in the torso section 12 of the doll body near the rearward portion thereof. Again, access may be obtained to the casing 76 and to the bank of batteries 74 by means of a openable door 78, also in the manner as illustrated in FIG. 3. In this way, the batteries can be changed as may be required. Moreover, the batteries located in the therapeutic doll figure could be recharged with a conventional battery recharging circuit (not shown).

The doors 72 and 78 which are openable and closable with respect to the respective casing 70 and 76 may be provided with some convenient locking means as for example, a latch which is rotatable through the turning of a handle on the door. Moreover, the doors would also be provided with a padding so as to conform to the remainder of the exterior portion of the therapeutic doll figure.

A speaker 80 may be connected to the electrical circuitry 64 and is located immediately rearwardly of an opening in the representation of the mouth 24. In this way, when a sound is generated through movement of the tape on the tape transport, that sound will emanate from the speaker 80 at the mouth portion of the therapeutic doll figure to provide a characterization of the doll figure talking. In addition, a pair of microphones 82 are provided and each is located immediately inwardly of the representation of an ear 26 on the opposite sides of the head section 10. In this way, the user can speak into either one of the microphones 82 for purposes of recording on the recordable tape 56.

It should be understood that the microphones and for that matter, the speaker could be located elsewhere on the therapeutic doll figure. However, to give a more realistic representation of a live figure, the speaker should preferably be located behind the opening in the mouth and the microphone should preferably be located behind openings in the representations of the ears 26.

The therapeutic doll figure could be provided with various other switches of the type normally found directly on the tape transport, such as a record switch 84, a replay switch 86 and a fast forward and fast reverse switch 88. These switches could be located in various convenient places on the body of the therapeutic doll figure. In the embodiment as illustrated, they have been shown on the representation of the belt 18. It should also be understood that other switches of this type could be included on the doll figure to provide other functions to the tape transport.

The switches 84, 86 and 88 could be located in other regions of the therapeutic doll figure, as for example, on hands thereof so that manual pressing will place the tape transport in a record mode or a replay mode or the like. The switches which are preferably push button switches may also be located in other portions of the body including the legs or the feet of the body of the doll figure. These switches would all be operatively coupled to the tape transport through electrical conductors which extend through the doll body.

It can be understood that the therapeutic doll figure is highly effective in that someone may record messages, as for example, messages of cheer on the tape for later replay by the user. As an example, a parent can record messages for a child located in a hospital environment to replay after the parent has left. In this way, the child can listen to the message of the parent by turning the transport on by pressing the switch behind the representation of the heart and the message will appear as though it is emanating from the mouth of the therapeutic doll figure.

The child user can also record his or her own message for later replay by the adult and this also has a therapeutic effect on the adults who may not be able to be with their children when the latter are in a hospital environment.

The therapeutic doll figure of the invention also has a variety of other modes of use, as for example, in a child therapy setting. As indicated above, and in many cases, it is difficult for a child to express his or her feelings to a therapist although the child may be more readily capable of expressing such feelings directly to a doll figure, such as the therapeutic doll figure of the invention. In this way, the child can talk into the ear of the therapeutic doll figure and the information recorded on the tape can then later be played by the therapist.

The above are only a few examples of a large number of uses of a therapeutic doll figure and it should be understood that this doll figure can find effective employment in a variety of therapeutic situations.

As indicated above, the therapeutic doll figure of the invention can have its facial expression and features changed. Here again, these features can be changed so as to represent some known or unknown person. The invention as illustrated only includes a few of the features which can be added to or removed from the face of the therapeutic doll figure. Here again, it should be understood that a larger number of components can be provided for attachment to and removal from the representation of the face in order to achieve a desired appearance and facial expression.

Thus there has been illustrated and described a unique and novel therapeutic doll figure which is capable of having messages recorded therein and capable of being replayed and which also is capable of having facial expressions changed to generally represent a known or unknown person. This therapeutic doll figure therefore fulfills all of the advantages which have been sought. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention is covered by the invention which is limited only by the following claims.

Having thus described my invention what I desire to claim and secure by Letters Patent is:

1. A therapeutic doll figure capable of receiving and recording speech of a person and generating speech of that person to simulate the presence of that person and capable of having the facial expression altered to represent known or unknown persons through the doll figure, said doll figure comprising:

(a) a doll body having a head section and a torso section, said head secton having a representation of a human face thereon including a representation of eyes, a representation of a mouth and a representation of a nose, (b) a first means of attachment associated with and closely located with respect to the representation of a mouth and which enables attachment and removal of an element to enable alteration of facial appearance, (c) a second means of attachment associated with and closely located with respect to the representations of eyes and which enables attachment and removal of an element to also enable alteration of facial appearance, and where the elements for attachment and removal enable the doll figure to represent a known or unknown human person, (d) a transport having a recordable media on which a spoken message may be recorded and from which the message may be reporduced, (e) read-write means associated with said transport for recording and reproducing the message from the recordable media, (f) a speaker located in or on said doll figure and operatively connected to said transport and read-write means to reproduce the message of a person through the doll figure to simulate the presence of the person producing the message, and (f) a microphone located in or on said doll figure and operatively connected to said transport and read-write means to enable a message to be recorded on said recordable media.

2. The therapeutic doll figure of claim 1 further characterized in that said head section includes a representation of a mouth and said speaker is located in said head section immediately behind said representation of said mouth.

3. The therapeutic doll figure of claim 1 further characterized in that said head section includes a representation of an ear and said microphone is located in said head section immediately behind said representation of said ear.

4. The therapeutic doll figure of claim 1 further characterized in that said head section includes a representation of a mouth and said speaker is located in said head section immediately behind said representation of said mouth, and said head section also includes a representation of an ear and said microphone is located in said head section immediately behind said representation of said ear.

5. The therapeutic doll figure of claim 4 further characterized in that said doll figure comprises a representation of a human heart over the torso section, switch means immediately inwardly of said representation of said human heart manually actuable to start said transport.

6. The therapeutic doll figure of claim 5 further characterized in that said switch means is actuable by pressing on the representation of said human heart.

7. The therapeutic doll figure of claim 1 further characterized in that said transport is a tape transport and said recordable media is tape.

8. The therapeutic doll figure of claim 7 further characterized in that said read-write means comprise a read head and a write head.

9. A therapeutic doll figure in which facial expression of the doll figure can be altered to represent a known or unknown person, said doll figure comprising:

(a) a doll head having a representation of a human face thereon and including a representation of eyes, a representation of a mouth and a representation of a nose, (b) a first main fiber containing attachment strip located around the representation of a mouth to represent the lips surrounding the mouth and which also enables attachment and removal of an element to enable alteration of facial appearance, (c) second main fiber containing attachment strips closely located with respect to and immediately above the representations of eyes to represent eyebrows and which also enable attachment and removal of elements to also enable alteration of facial appearance, and where the elements for attachment and removal enable the doll figure to represent a human known or unknown person, (d) a first element adapted for attachment to the doll head in the region of the representation of the mouth strip and having a cooperating first main attachment strip for releasable attachment to the first main attachment strip, and (e) second elements adapted for attachment to the doll head in the region of the eyes and having cooperating second attachment strips for releasable attachment to the second main attachment strips.

10. The therapeutic doll figure of claim 9 further characterized in that the first and second main attachment strips are Velcro strips and which also combine with the face on the doll head to provide a facial expression in absence of any attachment of elements thereto.

11. The therapeutic doll figure of claim 9 further characterized in that the cooperating first and second attachment strips on the elements which are to be attached also are mating Velcro strips.

12. The therapeutic doll figure of claim 9 further characterized in that said doll figure comprises a message recording and reproducing mechanism with a speaker located on or in said doll figure and a microphone located on or in said doll figure for recording and reproducing a message.

13. A therapeutic doll figure capable of receiving and recording speech of a person and generating speech of that person to simulate the presence of that person through the doll figure, said doll figure comprising:

(a) a doll body having a head section and a torso section and where the head section includes a representation of an ear and a representation of a mouth, (b) a tape transport having a recordable tape cassette on which a spoken message may be recorded and from which the message may be reproduced, (c) read-write means associated with said transport for recording and reproducing the message from the recordable media, (d) a speaker located in said doll figure immediately behind the representation of the mouth and operatively connected to said transport and said read-write means to reproduce the message of a person through the doll figure to simulate the presence of the person producing the message, (e) a microphone located in or on said doll figure immediately behind the representation of an ear and operatively connected to said transport and read-write means to enable a message to be recorded on said recordable media, (f) a representation of a human heart on the torso section, and (g) switch means immediately inwardly of said representation of said human heart manually actuable by pressing on the representation of said human heart to start said tape transport.

14. The therapeutic doll figure of claim 13 further characterized in that said read-write means comprise a read head and a write head.

15. A therapeutic doll figure comprising:

(a) a doll body having a head section and a torso section where the head section has a representation of a human face including a representation of ears, a representation of a mouth, and a representation of eyes, (b) a transport having a recordable media on which a spoken message may be recorded and from which the message may be reproduced, (c) read-write means associated with said transport for recording and reproducing the message from the recordable media, (d) a speaker located in or on said doll figure and operatively connected to said transport and read-write means to reproduce the message of a person through the doll figure to simulate the presence of the person producing the message, (e) a microphone located in or on said doll figure and operatively connected to said transport and read-write means to enable a message to be recorded on said recordable media, (f) a first means of attachment associated with and closely located with respect to the representation of a mouth and which enables attachment and removal of an element to enable alteration of facial appearance, and (g) a second means of attachment associated with and closely located with the representations of eyes and which enables attachment and removal of an element to also enable alteration of facial appearance, and where the elements for attachment and removal enable the doll figure to represent a known or unknown human person.

16. The therapeutic doll figure of claim 15 further characterized in that said head section includes a representation of a mouth and said speaker is located in said head section immediately behind said representation of said mouth.

17. The therapeutic doll figure of claim 16 further characterized in that said head section includes a representation of an ear and said microphone is located in said head section immediately behind said representation of said ear.

18. The therapeutic doll figure of claim 17 further characterized in that the first and second means for attachment and removal are Velcro strips and which also combine with the human face on the doll head to provide a facial expression in absence of any attachment of elements thereto.

* * * * *